10/8/85 OP 4,545,885

United States Patent [19]

Hori et al.

[11] Patent Number: 4,545,885

[45] Date of Patent: Oct. 8, 1985

[54] SELECTIVE ELECTROPLATING APPARATUS HAVING A CLEANING DEVICE

[75] Inventors: Kuniyuki Hori, Suzaka; Kiyoshi Kitazawa, Kohshoku, both of Japan

[73] Assignee: Shinko Electric Industries Co., Inc., Nagano, Japan

[21] Appl. No.: 640,578

[22] Filed: Aug. 14, 1984

[30] Foreign Application Priority Data

Jun., 1984 [JP] Japan ..... 59-110937

[51] Int. Cl.[4] ..... C25D 17/00; C25D 19/00

[52] U.S. Cl. ..... 204/207; 204/224 R

[58] Field of Search ..... 204/224 R, 207

[56] References Cited

U.S. PATENT DOCUMENTS 3,723,283 3/1973 Johnson ..... 204/224 R
4,069,126 1/1978 Abei ..... 204/207
4,230,538 10/1980 Turner ..... 204/207
4,315,809 2/1982 Phillips ..... 204/224 R
4,378,283 3/1983 Seyffert ..... 204/224 R

*Primary Examiner*—T. M. Tufariello
*Attorney, Agent, or Firm*—Staas & Halsey

[57] ABSTRACT

A selective electroplating apparatus including a masking member and a back-up plate for supporting a metal strip of lead frame therebetween. Electrolyte or electroplating liquid is sprayed through an aperture of the masking member onto a selective portion of the strip. Electric voltage is applied between an anode and the cathodically charged lead frame strip to form an electroplated layer on the selective portion of the strip. The masking member and the back-up plate are brought toward each other to support and contact the strip therebetween and away from each other to define a clearance therebetween, in each cycle of the electroplating process. Cleaning liquid is sprayed into the clearance defined between the masking member and the back-up plate during or after they are brought away from each other.

21 Claims, 6 Drawing Figures

SELECTIVE ELECTROPLATING APPARATUS HAVING A CLEANING DEVICE

BACKGROUND OF THE INVENTION

1. Field of the Invention

The present invention relates to a selective or spot electroplating apparatus, hereinafter referred to as a "selective plating apparatus", and, more particularly, to such an apparatus having a cleaning device for plating an elongated strip of metal, hereinafter referred to as "strip", in a predetermined interval in the lengthwise direction thereof.

The selective plating apparatus of this type can be advantageously employed for plating required portions of a lead frame that is used for the manufacture of semiconductor devices, for example integrated circuits, (IC's) and large scale integrated circuits (LSI's). In this case, the lead frame strip has a number of consecutive, identical segments formed in the lengthwise direction, wherein each segment is formed at the central portion thereof. Each segment includes a die-bonding area on which a semiconductor chip, such as an IC or LSI, is mounted and a number of leads having their tip ends, i.e., a wire-bonding area, surrounding the above-mentioned die-bonding area.

2. Description of the Prior Art

A selective plating apparatus adaptable for plating lead frames of this kind is known in the prior art, and comprises masking means having an aperture which allows electrolyte or electroplating liquid to be sprayed only onto the required portions of the lead frame, i.e., a die-bonding area and a wire-bonding area formed therearound at the central portion of each segment, and prevents the electrolyte from affecting the other portions. According to such a selective plating apparatus, the electrolyte discharged from a nozzle is sprayed onto the predetermined area of a substrate and, at the same time, an electric voltage is applied between an anode and the cathodically charged lead frame to form a desired electroplated metal layer.

When conducting selective plating with a masking means onto a lead frame, the strip is conventionally supported directly between a masking member and a back-up plate and the electrolyte is applied to the strip through an aperture of the masking member. Therefore, if the masking member and back-up plate used to support the strip therebetween are dirty or stained, the quality of the electroplated strip would be considerably reduced. Consequently, if excess electrolyte adheres to the masking member or the back-up plate, and also adheres to the strip per se, the plating metal may be electrolytically replaced or substituted and appearance and function of the plated product may be significantly damaged. Especially, when silver was used for electroplating, the electrolytical replacement would readily take place. Therefore, it has long been felt necessary to provide means for cleaning the strip, the masking member, and the back-up plate at each cycle of selective plating.

SUMMARY OF THE INVENTION

An object of the present invention is to provide a selective plating apparatus capable of overcoming the problems mentioned above with reference to the prior art.

Accordingly, a primary object of the present invention is to provide a selective plating apparatus, including: means for supporting a metal strip of a lead frame between a masking member and a back-up member; means for spraying electrolyte through a masking aperture of the masking member onto a selective area of the lead frame; means for applying electric voltage between an anode and the strip (cathode); and a cleaning device for cleaning the strip, masking member, and back-up plate at each cycle of the electroplating in order to prevent the plating metal from being electrolytically replaced, and to improve the quality of the lead frames, as well as to prevent or reduce the plating metal in the electrolyte from being carried over to the succeeding process.

According to the present invention, there is provided a selective electroplating apparatus comprising: means for supporting a metal strip of a lead frame between a masking member and a back-up plate; means for spraying electrolyte or electroplating liquid through a masking aperture of the masking member onto a selective portion of the strip; and means for applying electric voltage between an anode and the cathodically charged lead frame strip to form an electroplated layer on the selective area of the strip; means for bringing the masking member and the back-up plate toward each other to support and contact the strip therebetween, and away from each other to define a clearance therebetween, in each cycle of the electroplating process; and means for spraying cleaning liquid into the clearance defined between the masking member and back-up plate during or after they are brought away from each other.

The apparatus may also comprise: means for spraying cleaning liquid from the top of the clearance defined between the masking member and back-up plate; means for collecting the used cleaning liquid including a reservoir located under the clearance; and means for recirculating the used cleaning liquid thus collected so as to use it again as cleaning liquid. The apparatus may further comprise: means for collecting the used electrolyte or electroplating liquid; means for mixing the electrolyte thus collected with the collected used cleaning liquid; and means for recirculating the mixture thus obtained so as to use it again as electrolyte or electroplating liquid. It is advantageous to provide means for mixing cleaning liquid with air so as to inject the mixture as a mist into said clearance. The cleaning liquid is pure water, or contains an agent for preventing electrolytical replacement.

DETAILED DESCRIPTION OF THE PREFERRED EMBODIMENTS

Embodiments of the invention will be described below with reference to the accompanying drawings.

Figure 1:
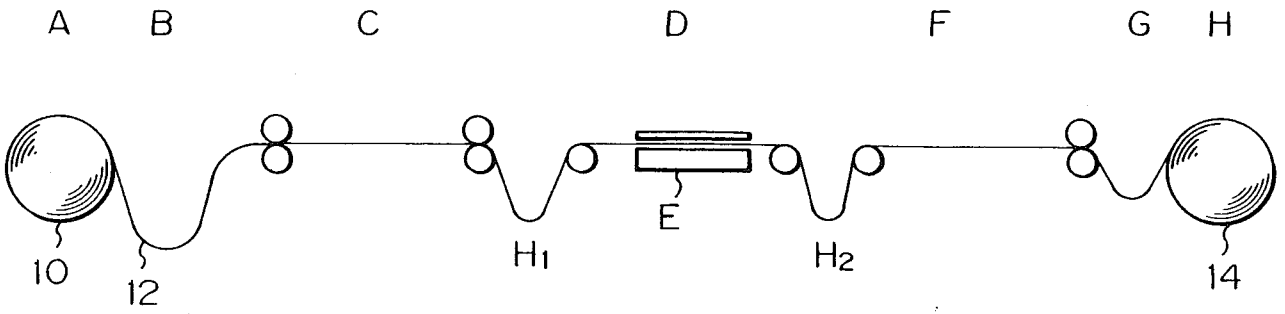
FIG. 1 is a schematic diagram of operation of the selective plating apparatus of the present invention.

FIG. 1 is a schematic diagram of the steps for selective plating a metal strip of a lead frame to be used as a package for a semiconductor device, such as an IC, LSI and the like. In FIG. 1; symbol A denotes a strip discharge section for delivering a strip 12 that is wound on a reel 10; B denotes a slackening section of the strip 12; C denotes a station for pre-treating the strip 12 where the surface of the strip 12 is washed to remove oil, oxide or contaminants; D denotes a station where selective plating is conducted on the strip 12; E denotes a plating head; F denotes a station for after-treating the strip 12 where the plating solution residing on the strip 12 is washed away and the strip 12 is then dried; G denotes a slackening section like the slackening section B; and H denotes a strip take up section where the strip 12 is wound on a reel 14. $H_1$ denotes a transitional section where continuous feeding of the strip 12 is changed to intermittent feeding thereof, while $H_2$ denotes another transitional section where intermittent feeding of the strip 12 is changed to continuous feeding thereof.

Figure 2:
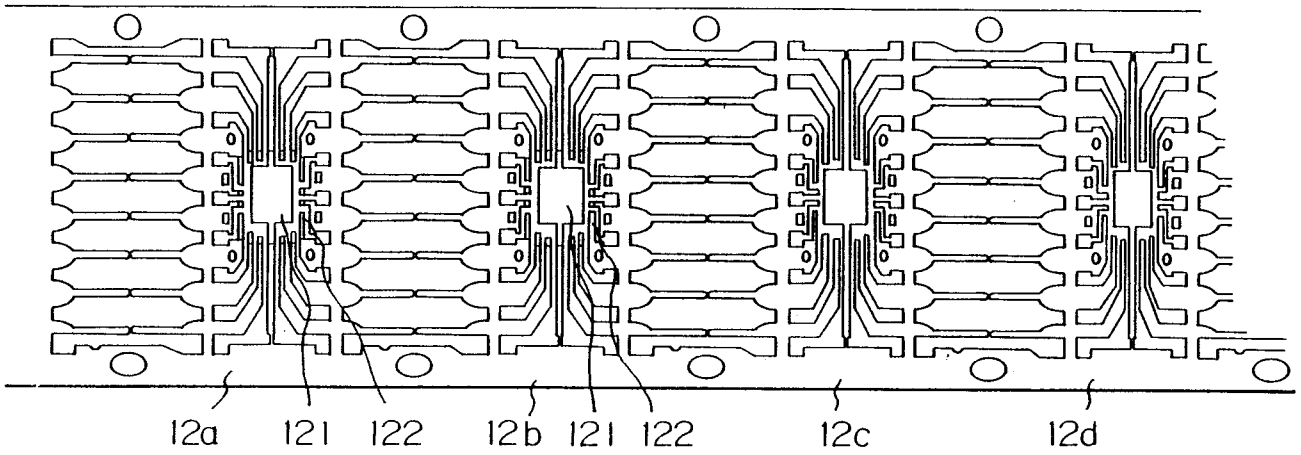
FIG. 2 is a plan view of an elongated metal strip which constitutes a lead frame.

The strip 12 consists of a lead frame as illustrated in FIG. 2, and has a number of segments 12*a*, 12*b*, 12*c*, 12*d* etc., which are of the same shape, are formed by stamping and are continuously connected in the lengthwise direction. Each segment is formed at the central portion thereof with a die-bonding area 121 where a semiconductor chip (not shown) is mounted and has a number of leads, the tips of which are gathered around the above-mentioned die-bonding area to form a wire-bonding area 122, which is the portion to be connected to the semi-conductor chip by means of fine metal wires.

In FIG. 1, the strip 12 is fed continuously to the pre-treating station C and to the after-treating station F. However, in order to carry out the plating through the masking means, the strip 12 is fed intermittently to the plating station D.

Figure 3:
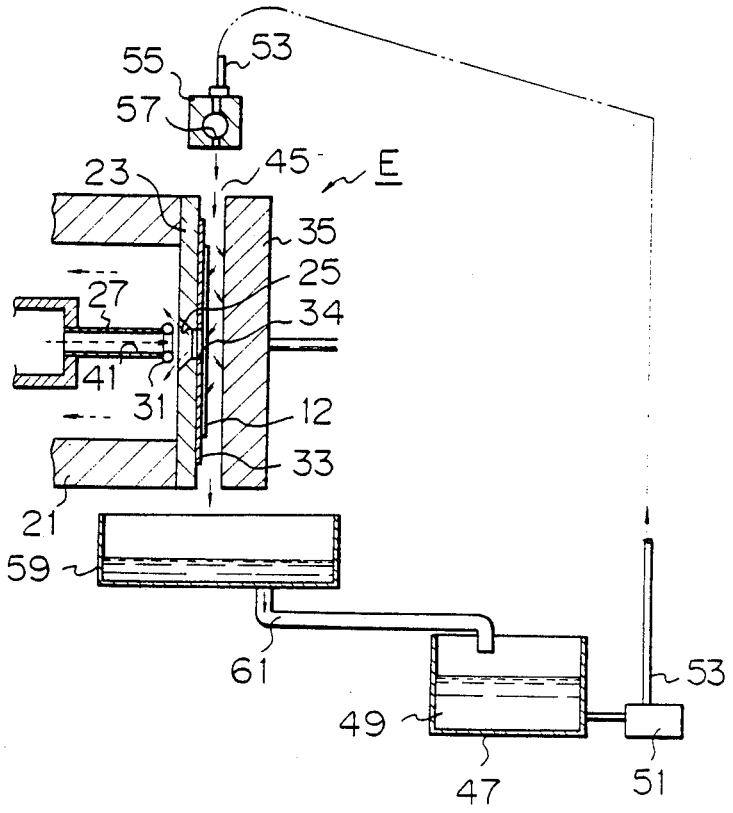
FIG. 3 is a cross-sectional view of a first embodiment of a cleaning device according to the present invention.
Figure 5:
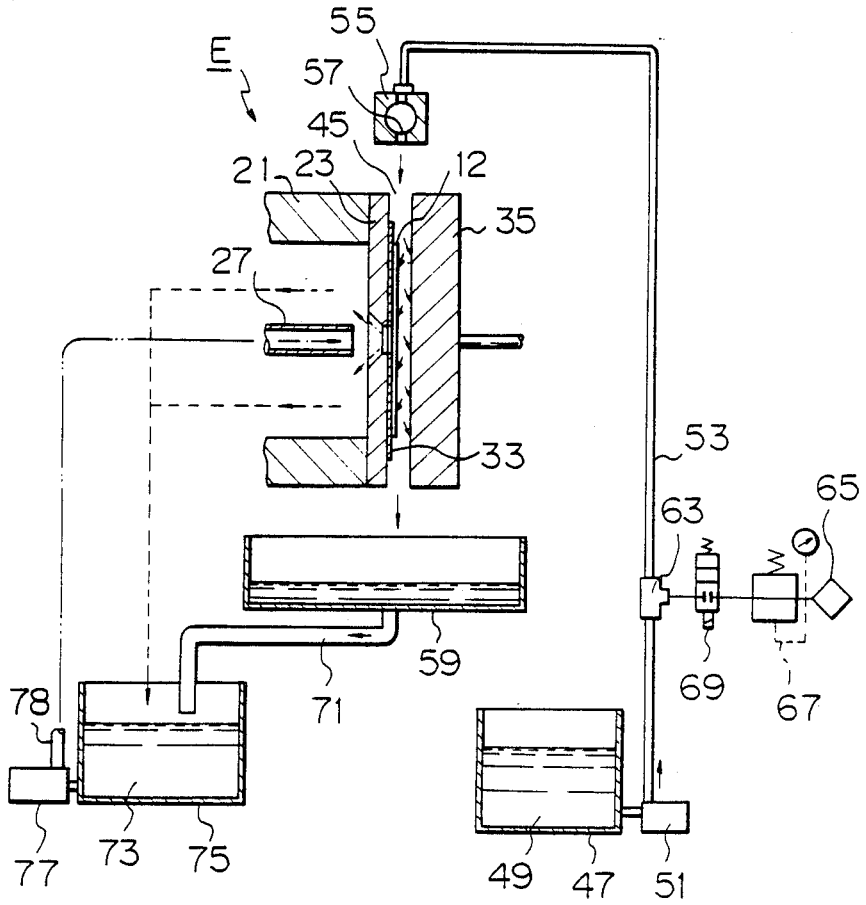
FIG. 5 is a cross-sectional view of a second embodiment of the cleaning device according to the present invention; and, FIG. 6 is a cross-sectional view of a third embodiment of the cleaning device according to the present invention.

FIG. 3 is a detailed illustration of the plating head E in the plating station D. A casing 21 of the plating head E is provided with a masking member 23 which has a rectangular plating aperture 25 having a size corresponding to the die-bonding area 121 and wire-bonding area 122 in the lead frame 12 on which electroplating is to be conducted. In the casing 21, a nozzle 27 for injecting electrolyte or plating liquid is provided at the position corresponding to the plating aperture 25 and is connected to a pump 77 (FIG. 5). A platinum (Pt) wire 31 is attached to the tip of the nozzle 27 to serve as an anode. On the surface of the masking plate 23 is attached a sealing masking rubber 33 which also has an aperture 34 corresponding to the electroplating or masking aperture 25 of the masking member 23.

The strip 12 is moved intermittently in the electroplating head E, between the masking rubber 33 and a back-up plate 35. While the strip 12 is stopped, the back-up plate 35, which is located opposite the masking plate 23, pushes and supports the strip 12 against the masking plate 23. Consequently, a rectangular area of the strip 12, including the die-bonding area 121 and the wire-bonding area 122, is exposed through the electroplating aperture 25 of the masking member 23.

The electrolyte flow is fed from the pump 77 (FIG. 5) to the nozzle 27, which injects the electrolyte through a nozzle port 41. The injected electrolyte is sprayed through the aperture 25 of the masking plate 23 and onto the substrate, i.e., the lead frame 12. The electroplating is bonded to the lead frame 12 at the area corresponding to the masking plate aperture 25 by an electric voltage between the platinum wire 31 (anode) and the cathode of the lead frame 12.

When the electroplating is finished by halting the injection of the electrolyte from the nozzle 27, the back-up plate 35 is retracted to a position opposite that of the masking member 23, so that a clearance 45 (FIG. 3) is formed between the back-up plate 35 and the masking member 23.

Figure 4:
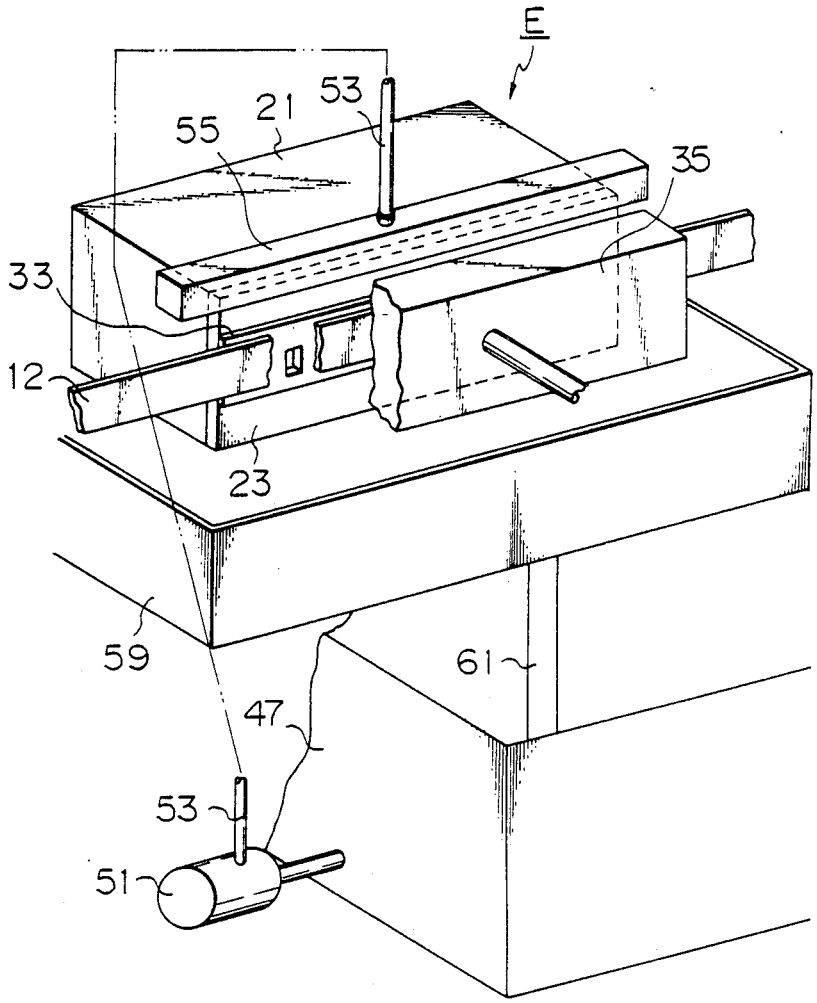
FIG. 4 is a perspective view of the cleaning device illustrated in FIG. 3.

A first embodiment of a cleaning device of the selective plating apparatus of the present invention is illustrated in FIGS. 3 and 4. The cleaning liquid 49 (FIG. 3) is supplied from the tank 47 by a pump 51 through a pipe 53 to a nozzle 55 for injecting the cleaning liquid, which nozzle 55 is located above the clearance 45 defined between the masking member 23 and the back-up plate 35. The nozzle 55 is provided with a plurality of circular nozzle apertures or a slit 57 (FIG. 3) for spraying the cleaning liquid, as shown by solid line arrows (FIG. 3) into the clearance 45 (FIG. 3) defined between the masking member 23 and the back-up plate 35. Therefore, the masking member 23 (including the masking rubber 33), the plated lead frame 12 and the back-up plate 35 are cleaned and the excess electrolyte adhered thereto during the electroplating process can be removed with the cleaning liquid. The used cleaning liquid is collected into a reservoir 59 and returned to the tank 47 through a pipe 61.

During or after the cleaning operation, the lead frame 12 is moved forward in the lengthwise direction by a predetermined length and stopped at the subsequent plating position. The lead frame 12 is again pushed by the back-up plate 35 and supported on and contacted by the masking member 23, so that the lead frame 12 is prepared for electroplating. At this time, no excess electrolyte remains on the masking member 23, the lead frame 12, and the back plate 35, since they have been cleaned, thereby preventing electrolytical replacement or substitution from occurring on unnecessary portions of the lead frame 12. Although pure water can be used as the cleaning liquid, a liquid containing an agent for preventing electrolytical substitution may also be advantageously used, provided that the agent has no affect on the electrolyte bath. In FIG. 3, the flow of the electrolyte being injected through the injection nozzle 27 is indicated by dotted line arrows.

FIG. 5 illustrates a second embodiment of the cleaning device, in which the aspects distinguishing this embodiment from the first embodiment as shown in FIG. 3 are as follows. The pipe 53 for supplying the cleaning liquid 49 is provided with a T-shaped manifold 63, so that the cleaning liquid supplied by the pump 51 is mixed with air which is introduced into the pipe 53 through an air filter 65, an air regulator 67 and a solenoid air valve 69. The cleaning liquid, therefore, becomes misty and is injected in that state into the clearance 45 through the nozzle apertures or slit 57 of the nozzle 55, to clean the masking plate 23, the lead frame 12, and the back plate 35.

The misty cleaning media is advantageous when used for cleaning, in that, with a small amount of only 2 ml of cleaning liquid, it is possible to effectively clean an area corresponding to approximately a 400 mm length of the lead frame 12 within a limited clearance 45 having a 20 mm width. Therefore, the amount of cleaning liquid required for each cycle of the cleaning operation is very small.

Some of the plating liquid in the electrolyte bath 73 may be reduced due to evaporation or the like. Thus, after the used cleaning liquid has been collected in the reservoir 59, it can be added to an electrolyte bath 73 through a pipe 71. In addition, according to this embodiment, since the used cleaning liquid is not added to the tank 47, the cleaning is always conducted with fresh cleaning liquid, thereby further improving the cleaning efficiency.

The amount of cleaning liquid to be used for one electroplating cycle can be increased by applying vacuum suction to the electrolyte tank 75 to promote the evaporation of the electrolyte bath 73, which can be expected to further improve the cleaning efficiency. The electrolyte bath 73 is supplied as electroplating liquid to the electrolyte injection nozzle 27 through a pipe 78 by a pump 77.

Figure 6:
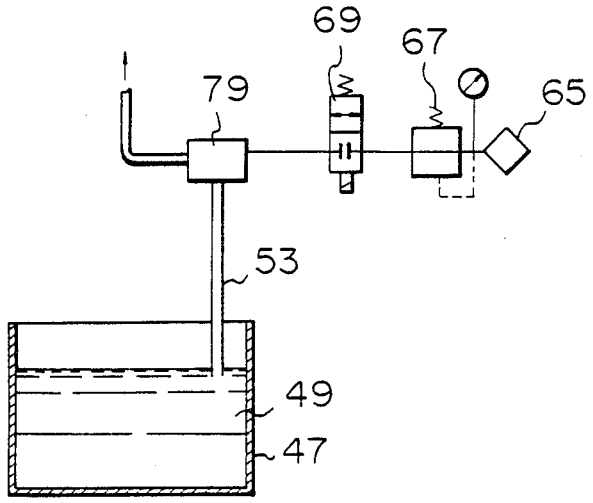

FIG. 6 is a partial illustration of a third embodiment of the cleaning device, in which a part of the second embodiment illustrated in FIG. 5 is modified. That is, a vacuum generator 79 is provided in the pipe 53. Air is supplied into this vacuum generator 79 through an air filter 65, an air regulator 67, and a solenoid air valve 69, so that cleaning liquid is sucked from the tank 47 and mixed with the air in the vacuum generator 79 to produce a misty cleaning media, which is then injected through the injection nozzle 55 (FIG. 5) into the clearance 45.

In the above-mentioned embodiments, although the masking means is fixed, while the back plate is movable, it should be noted that it is also possible to make the back-up plate fixed and the masking member movable, or to make both the masking member and back-up plate movable.

We claim:

1. A selective electroplating apparatus to be used in an electroplating process, commprising:

(a) means for supporting a metal strip of lead frame between a masking member having a masking aperture and a back-up plate;

(b) means for spraying electroplating liquid through the masking aperture of the masking member onto a selective area of the lead frame strip;

(c) means for supplying electric voltage between an anode and the lead frame strip which has been cathodically charged to form an electroplated layer on the selective area of the strip;

(d) means for moving the masking member and the back-up plate toward each other to support and contact the strip therebetween and away from each other to define a clearance therebetween in each cycle of the electroplating process; and (e) means for spraying cleaning liquid into said clearance defined between said masking member and back-up plate after the masking member and the back-up plate are moved away from each other.

2. A selective electroplating apparatus as set forth in claim 1, wherein said apparatus further comprises:

(f) means for collecting the used cleaning liquid; and (g) means for recirculating the used cleaning liquid thus collected so as to use it again as cleaning liquid, and wherein said means for spraying cleaning liquid sprays the cleaning liquid from the top of the clearance.

3. The selective electroplating apparatus as set forth in claim 2, wherein the means for collecting the used cleaning liquid comprises a reservoir located under said clearance.

4. A selective electroplating apparatus as set forth in claim 1, wherein the cleaning liquid is pure water.

5. A selective electroplating apparatus as set forth in claim 1, wherein the cleaning liquid comprises an agent for preventing electrolytical replacement.

6. The selective electroplating apparatus as set forth in claim 1, wherein the means for spraying cleaning liquid comprises:

(i) a cleaning liquid tank;

(ii) a pump operatively connected to the cleaning liquid tank;

(iii) a nozzle located above the clearance; and (iv) a pipe operatively connecting the pump and the nozzle.

7. The selective electroplating apparatus as set forth in claim 6, wherein the means for spraying cleaning liquid further comprises:

(v) means operatively connected to the pipe for introducing air into the pipe.

8. The selective electroplating apparatus as set forth in claim 7, wherein the means for spraying the cleaning liquid further comprises:

(vi) a vacuum generator operatively connected to the pipe.

9. A selective electroplating apparatus to be used in an electroplating process, comprising:

(a) means for supporting a metal strip of lead frame between a masking member having a masking aperture and a back-up plate;

(b) means for spraying electroplating liquid through the masking aperture of the masking member onto a selective area of the lead frame strip;

(c) means for applying electric voltage between an anode and the lead frame strip which has been cathodically charged to form an electroplated layer on the selective area of the strip;

(d) means for moving the masking member and the back-up plate relative to each other to define a clearance therebetween in each cycle of the electroplating process;

(e) means for spraying cleaning liquid into said clearance defined between said masking member and back-up plate;

(f) means for collecting the used cleaning liquid;

(g) means for collecting the used electroplating liquid;

(h) means for mixing the collected electroplating liquid with the collected used cleaning liquid; and (i) means for recirculating the mixture thus obtained so as to use it again as electroplating liquid.

10. A selective electroplating apparatus as set forth in claim 9, wherein the cleaning liquid is pure water.

11. A selective electroplating apparatus as set forth in claim 9, wherein the cleaning liquid comprises an agent for preventing electrolytical replacement.

12. The selective electroplating apparatus as set forth in claim 9, wherein the means for collecting the used cleaning liquid comprises a reservoir located under said clearance.

13. The selective electroplating apparatus as set forth in claim 9, wherein the means for spraying cleaning liquid comprises:

(i) a cleaning liquid tank;

(ii) a pump operatively connected to the cleaning liquid tank;

(iii) a nozzle located above the clearance; and (iv) a pipe operatively connecting the pump and the nozzle.

14. The selective electroplating apparatus as set forth in claim 13, wherein the means for spraying cleaning liquid further comprises:

(v) means operatively connected to the pipe for introducing air into the pipe.

15. The selective electroplating apparatus as set forth in claim 14, wherein the means for spraying the cleaning liquid further comprises:

(vi) a vacuum generator operatively connected to the pipe.

16. A selective electroplating apparatus to be used in an electroplating process, comprising:

(a) means for supporting a metal strip of lead frame between a masking member having a masking aperture and a back-up plate;

(b) means for spraying electroplating liquid through the masking aperture of the masking member onto a selective area of the lead frame strip;

(c) means for applying electric voltage between an anode and the lead frame strip which has been cathodically charged to form an electroplated layer on the selective area of the strip;

(d) means for moving the masking member and the back-up plate relative to each other to define a clearance therebetween in each cycle of the electroplating process;

(e) means for spraying cleaning liquid into said clearance defined between said masking member and back-up plate; and (f) means for mixing said cleaning liquid with air so as to inject the mixture as a mist into said clearance.

17. A selective electroplating apparatus as set forth in claim 16, wherein the cleaning liquid is pure water.

18. A selective electroplating apparatus as set forth in claim 16, wherein the cleaning liquid comprises an agent for preventing electrolytical replacement.

19. The selective electroplating apparatus as set forth in claim 18, wherein the means for spraying cleaning liquid comprises:

(i) a cleaning liquid tank;

(ii) a pump operatively connected to the cleaning liquid tank;

(iii) a nozzle located above the clearance; and (iv) a pipe operatively connecting the pump and the nozzle.

20. The selective electroplating apparatus as set forth in claim 19, wherein the means for spraying cleaning liquid further comprises:

(v) means operatively connected to the pipe for introducing air into the pipe.

21. The selective electroplating apparatus as set forth in claim 20, wherein the means for spraying the cleaning liquid further comprises:

a vacuum generator operatively connected to the pipe.

* * * * *